US005496484A

United States Patent [19]

Shima et al.

[11] Patent Number: 5,496,484

[45] Date of Patent: Mar. 5, 1996

[54] ELECTROVISCOUS FLUIDS CONTAINING SEMICONDUCTING PARTICLES AND DIELECTRIC PARTICLES

[75] Inventors: Koji Shima, Machida; Yukio Chida, Tokyo; Iwao Yamamoto, Yokohama; Kenji Watanabe, Sagamihara, all of Japan

[73] Assignee: Mitsubishi Chemical Corporation, Tokyo, Japan

[21] Appl. No.: 357,344

[22] Filed: Dec. 15, 1994

Related U.S. Application Data

[63] Continuation of Ser. No. 987,731, Dec. 8, 1992, abandoned.

[30] Foreign Application Priority Data

Dec. 17, 1991 [JP] Japan ..... 3-333535

[51] Int. Cl.[6] ..... C10M 171/00; C10M 169/04

[52] U.S. Cl. ..... 252/74; 252/73; 252/572

[58] Field of Search ..... 252/73, 74, 572

[56] References Cited

U.S. PATENT DOCUMENTS 4,687,589 8/1987 Block et al. ..... 252/73

FOREIGN PATENT DOCUMENTS

| | | |
|---|---|---|
| 0361931 | 4/1990 | European Pat. Off. . |
| 0455362A2 | 11/1991 | European Pat. Off. . |
| 53-17585 | 2/1978 | Japan . |
| 61-216202 | 9/1986 | Japan . |
| 63-97694 | 4/1988 | Japan . |
| 2-169695 | 6/1990 | Japan . |
| 3-160094 | 7/1991 | Japan . |

OTHER PUBLICATIONS

T. Sasada et al: Proc. 17th Japan Cong. Mater. Res., 228 Mar. 1974.

Patent Abstracts of Japan vol. 16, No. 54 (C–909) (5097) Feb. 1992, Japanese Patent 3–255196.

*Primary Examiner*—Christine Skane

*Attorney, Agent, or Firm*—Nixon & Vanderhye

[57] ABSTRACT

Disclosed herein is an electroviscous fluid comprising an electrical insulating liquid and particles dispersed therein, said particles being composed of semiconducting particles having a weight average particle size of 1 to 100 μm and dielectric particles having a weight average particle size of 1 to 3 μm, the weight average particle size of the dielectric particles being not more than 30% of that of the semiconducting particles, the amount of the dielectric particles being 5 to 40 vol % based on the total particles, and the amount of the particles in the whole fluid being 10 to 60 vol %.

9 Claims, 1 Drawing Sheet

ELECTROVISCOUS FLUIDS CONTAINING SEMICONDUCTING PARTICLES AND DIELECTRIC PARTICLES

This is a continuation of application Ser. No. 07/987,731, filed Dec. 8, 1992, now abandoned.

BACKGROUND OF THE INVENTION

The present invention relates to an electroviscous fluid and, more particularly, to an electroviscous fluid which has an excellent insulating property, which is usable in a high electric field and which generates an excellent electroviscous effect. The electroviscous fluid is useful for a vibration isolator and a power transmission which are electrically controllable.

The electroviscous fluid is a fluid whose apparent viscosity rapidly and reversibly changes depending on ON and OFF (change) of an electric field applied.

The electroviscous fluid is generally produced by dispersing polarizable particles in an electrical insulating liquid. It is considered that an electroviscous effect is produced as follows. When an electric field is applied to the electroviscous fluid, the particles dispersed in the liquid are polarized and agglomerate in the form of a chain by electrostatic attraction based on the polarization. As a result, an electroviscous effect is displayed.

As such electroviscous fluid, many kind of electroviscous fluid containing particles which have adsorbed a polarizable solvent such as water, as the dispersed particles, are conventionally known. As a fluid containing particles having no adsorbent, as the dispersed particles, have been proposed a fluid containing semiconducting particles such as polyacene quinone (Japanese Patent Application Laid-Open (KOKAI) No. 216202/1986), a fluid containing electrical conductive particles such as particles of aluminum covered with an electrical insulating film (T. Sasada et al: Proc. 17th Japan Cong. Mater. Res., 228 (1974)), a fluid containing composite particles having a three-layered structure with an electrical conductive layer such as a metal layer disposed as an intermediate layer (Japanese Patent Application Laid-Open (KOKAI) No. 97694/1988), a fluid containing dielectric particles such as barium titanate (Japanese Patent Application Laid-Open (KOKAI) No. 17585/1978), etc.

Furthermore, it has been also proposed a fluid containing particles having different particle sizes as the dispersed particles in order to enhance the redispersibility of the deposited particles (Japanese Patent Application Laid-Open (KOKAI) No. 160094/1991).

However, a fluid containing particles which have adsorbed a polarizable solvent such as water is disadvantageous in that when it is exposed to a high temperature for a long time, the adsorbent evaporates and the electroviscous effect is lowered.

As the fluid containing particles having no adsorbent, in the case of using the fluid containing composite particles, since it is difficult to cover the particles with a uniform thin film, a sufficient electroviscous effect is not always obtained. In the case of using the fluid containing only dielectric particles, since the specific gravity of the particles is generally high, the particles may disadvantageously sediment. In the case of using the fluid containing only semiconducting particles, the insulating property is insufficient, so that application of an electric field sometimes causes dielectric breakdown, and as a result, it is difficult to obtain a sufficient electroviscous effect. In the case of using the fluid containing particles having different particle sizes, the insulating property of the particles as a whole is sometimes lowered depending on the kinds of the particles, so that dielectric breakdown is caused in a low electric field, and as a result, it is difficult to obtain a sufficient electroviscous effect.

As a result of the inventors' studies to solve the above described problems, it has been found that by dispersing semiconducting particles having a comparatively large average particle size and dielectric particles having a smaller average particle size than that of the semiconducting particles in an electrical insulating liquid, obtained electroviscous fluid is not deteriorated at a high temperature, has an excellent insulating property, is usable in a high electric field and shows an excellent electroviscous effect. The present invention has been achieved on the basis of this finding.

SUMMARY OF THE INVENTION

In an aspect of the present invention, there is provided an electroviscous fluid comprising an electrical insulating liquid and particles dispersed therein, said particles being composed of semiconducting particles having a weight average particle size of 1 to 100 μm and dielectric particles having a weight average particle size of 1 to 3 μm, the weight average particle size of the dielectric particles being not more than 30% of that of the semiconducting particles, the amount of the dielectric particles being 5 to 40 vol % based on the total particles, and the amount of the particles being 10 to 60 vol % based on the whole fluid.

DETAILED DESCRIPTION OF THE INVENTION

Figure 1:
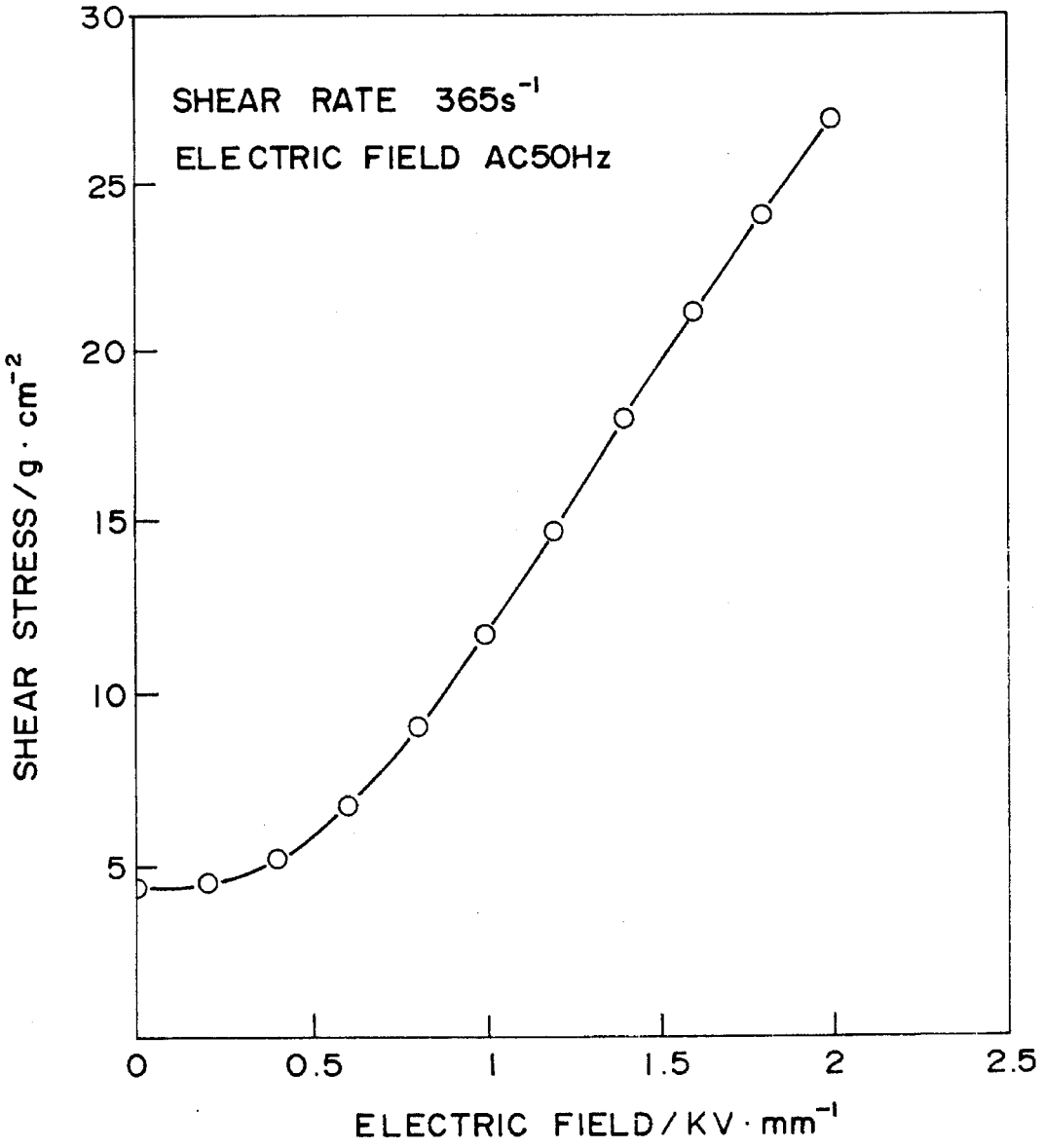
FIG. 1 is a graph showing a relation of the electroviscous effect of the electroviscous fluid in Example 1 to a voltage applied.

The electrical insulating liquid used in the present invention is a liquid having an insulating property corresponding to a resistivity of usually not less than $10^9$ Ωcm, preferably not less than $10^{10}$ Ωcm. As the electrical insulating liquid, for example, silicone oils, ester oils and mineral oils can be cited. More specifically, dimethyl polysiloxane, dioctyl phthalate, dibutyl phthalate, diisononyl phthalate, trioctyl trimellitate, triisodecyl trimellitate, dibutyl adipate, butyl stearate, paraffin-based mineral oil, naphthene-based mineral oil, may be exemplified.

The semiconducting particles used in the present invention are composed of a material having an electrical conductivity of usually $10^{-2}$ to $10^{-10}$ S·cm$^{-1}$, preferably $10^{-4}$ to $10^{-9}$ S·cm$^{-1}$. If the electrical conductivity is too low, it may be difficult to obtain an electroviscous effect. On the other hand, if the electrical conductivity is too high, application of an electric field may cause dielectric breakdown.

The preferred specific gravity of the semiconducting particles depends upon the particle size and the amount of particles added, but the semiconducting particles having a specific gravity of not more than 3, more preferably 0.7 to 2.5 are preferred in order to suppress the sedimentation of the particles. As the semiconducting particles used in the present invention, particles composed of a carbonaceous material such as coke, having the above-mentioned electric conductivity and obtained by heating a hydrocarbon at a temperature of not higher than 1000° C., copper phthalocyanine or polyacene quinone may be exemplified.

The semiconducting particles have a weight average particle size of 1 to 100 μm. If the weight average particle size is less than 1 μm, since the specific surface area of the particles increases, the viscosity of the electroviscous fluid at when no electric field is applied thereto may be so high that the ratio of the viscosity at when an electric field is applied to the viscosity at when no electric field is applied is reduced. On the other hand, if the weight average particle size is more than 100 μm, the particles may easily sediment, and a power exerted to each particle at when an electric field is applied becomes large, resulting in breakage or wear of the particle. The preferred weight average particle size of the semiconducting particles is 5 to 50 μm. The particle size distribution of the semiconducting particles is not specified, but particles uniform in size are preferred.

The dielectric particles used in the present invention are composed of an insulating material having a large dielectric constant. To produce a large electroviscous effect, the larger dielectric constant of the dielectric particles is preferable. The dielectric particles having a dielectric constant of not less than 100 are preferred. For example, particles of an inorganic dielectric material such as $BaTiO_3$, (Ba, Sr, Ca)$TiO_3$, (Ba, Ca)(Zr, Ti)$O_3$, Pb(Zn, Nb)$O_3$, Pb(Fe, Nb)$O_3$, Pb(Mg, Nb)$O_3$ and Pb(Fe, W) $O_3$ are usable.

The weight average particle size of the dielectric particles is 0.1 to 3 μm. If the weight average particle size is less than 0.1 μm, since the specific surface area of the particles increases, the viscosity of the electroviscous fluid at when no electric field is applied thereto may so high that the ratio of the viscosity at when an electric field is applied to the viscosity at when no electric field is applied is reduced. On the other hand, if the weight average particle size is more than 3 μm, the particles may easily sediment. The preferred weight average particle size of the dielectric particles is 0.3 to 2 μm. The particle size distribution of the dielectric particles is not specified, but particles uniform in size are preferred.

The weight average particle size of the dielectric particles not only satisfies the above described requirements but also is not more than 30%, preferably 0.1 to 20% of the weight average particle size of the semiconducting particles.

It is considered that by using the dielectric particles having a smaller average particle size than that of the semiconducting particles, the dielectric particles enter gaps between the semiconducting particles when the semiconducting particles agglomerate in the form of a chain at when an electric field is applied, thereby suppressing dielectric breakdown. Consequently, it is possible to apply a high electric field and to obtain a large electroviscous effect. By combining particles having different particle sizes, the viscosity of the electroviscous fluid at when no electric field is applied is reduced.

If the weight average particle size of the dielectric particles is more than 30% of that of the semiconducting particles, it is difficult to obtain the above described effect.

The amount of dielectric particles is 5 to 40 vol %, preferably 10 to 35 vol % based on the total particles. If it is less than 5 vol %, it may be difficult to obtain the above-mentioned effect. On the other hand, if it is more than 40 vol %, since the particles having a large specific gravity increase, the sedimentation of the particles sometimes arises. In addition, since the ratio of the fine particles increases, the viscosity of the electroviscous fluid at when no electric field is applied may be unfavorably increased.

The total amount of the particles in the whole fluid is 10 to 60 vol %, preferably 20 to 50 vol %. By relatively increasing the amount of the particles, electroviscous effect is enhanced and sedimentation of the particles is suppressed. If the amount is less than 10 vol %, it tends to be difficult to obtain the desired electroviscous effect and the particles tend to sediment If the amount is more than 60 vol % the viscosity at when no electrical field is applied tends to be too high and the fluidity of the electroviscous fluid tends to be poor.

In order to stabilize the dispersed state of the particles, it is possible to add a dispersant to the electroviscous fluid of the present invention. As the dispersant, modified silicone oils and esters are usable. Examples of them are amino-modified silicone oils, epoxy-modified silicone oils, epoxy polyether-modified silicone oils, acrylic ester polyfunctional ester polymers and polyvalent amine activators.

The electroviscous fluid of the present invention is excellent in the stability at a high temperature. For example, even if the electroviscous fluid is allowed to stand at room temperature for 3 days after allowed to stand at a temperature of 160° C. for 6 hours, no supernatant is separated nor deterioration in the properties is observed.

The electroviscous fluid of the present invention has an excellent insulating property, so that it is usable in a high electric field and it produces an excellent electroviscous effect.

EXAMPLES

The present invention will be explained in more detail hereinunder with reference to the following example and comparative examples. It is to be understood the present invention is not limited by the following examples unless it is out of the scope of the invention.

Example 1

Coal tar was heated to 500° C. to produce coke. The true specific gravity of the coke was 1.4. The coke was pulverized by a pulverizer, thereby obtaining semiconducting particles having a weight average particle size of 17 μm. (When the semiconducting particles were pressed to form a pellet, the electrical conductivity of the pellet was $10^{-7}$ $S \cdot cm^{-1}$)

$BaTiO_3$ particles having a weight average particle size of 0.68 μm, a specific gravity of 6.012 and a dielectric constant of 1500 were used as the dielectric particles. With 38.70 g of dioctyl phthalate having a specific gravity of 0.986 and 1.91 g of a polyfunctional dispersant (SN4114, produced by SANNOPCO, LTD.), 40.61 g of these particles were mixed and the resultant mixture was thoroughly dispersed by a paint shaker.

With the thus obtained slurry, 24.31 g of the semiconducting particles were mixed, and the resultant mixture was further dispersed by a paint shaker to obtain a sample.

The amount of the total particles in the whole fluid was 38 1 vol % the weight average particle size of the semiconducting particles was 17 μm, the weight average particle size of the dielectric particles was 0.68 μm, and the amount of the dielectric particles in the total particles was 28 vol %.

As the property of the obtained sample when an electric field was applied thereto, the shear stress was measured by using a coaxial-double cylinder rotational viscometer while applying a voltage between the outer and the inner cylinders. The shear rate was 365 $s^{-1}$, the distance between the electrodes was 1 mm, and the measuring temperature was 25° C. The results are shown in FIG. 1.

After the sample was allowed to stand at a temperature of 160° C. for 6 hours, it was further allowed to stand at room temperature for 3 days. No supernatant was separated nor deterioration in the properties was observed.

Comparative Example 1

The coke obtained in the same way as in Example 1 was pulverized to obtain semiconducting particles having a weight average particle size of 3.0 μm and semiconducting particles having a weight average particle size of 65 μm. With 38.70 g of dioctyl phthalate and 1.91 g of the same dispersant as in Example 1, 9.46 g of the semiconducting particles having a weight average particle size of 3.0 μm were mixed and the resultant mixture was thoroughly dispersed by a paint shaker.

With the thus obtained slurry, 24.31 g of the semiconducting particles having a weight average particle size of 65 μm were mixed and the resultant mixture was further dispersed by a paint shaker to obtain a sample.

The amount of the total particles in the whole fluid was 38 1 vol % and the amount of the semiconducting particles having a weight average particle size of 3.0 μm in the total particles was 28 vol %.

When the shear stress of the sample when an electric field was applied thereto was measured in the same way as in Example 1, dielectric breakdown was caused at 1.4 $kV \cdot mm^{-1}$. A sufficient electroviscous effect was not produced.

Comparative Example 2

The coke obtained in the same way as in Example 1 was pulverized to obtain semiconducting particles having a weight average particle size of 17 μm. With 38.70 g of dioctyl phthalate and 1.91 g of the same dispersant as in Example 1, 33.77 g of the semiconducting particles were mixed and the resultant mixture was thoroughly dispersed by a paint shaker.

The amount of the semiconducting particles in the whole fluid was 38.1 vol %.

When the shear stress of the sample when an electric field was applied thereto was measured in the same way as in Example 1, dielectric breakdown was caused at 1.4 $kV \cdot mm^{-1}$. A sufficient electroviscous effect was not produced.

Comparative Example 3

With 38.70 g of dioctyl phthalate and 1.91 g of the same dispersant as in Example 1, 145.03 g of $BaTiO_3$ particles used in Example 1 were mixed and the resultant mixture was thoroughly dispersed by a paint shaker.

The amount of the dielectric particles in the whole fluid was 38.1 vol %.

When the sample was heated and allowed to stand in the same way as in Example 1, sedimentation of the particles was remarkable.

What is claimed is:

1. An electroviscous fluid comprising an electrical insulating liquid and particles dispersed therein, said particles being composed of (i) semiconducting particles selected from the group consisting of carbonaceous material and polyacene quinone, having a weight average particle size of 1 to 100 μm and composed of a material having an electrical conductivity of $10^{-2}$ to $10^{-10}$ $S \cdot cm^{-1}$ and (ii) dielectric particles selected from the group consisting of titanate dielectric particles and lead containing oxide dielectric particles having a weight average particle size of 0.1 to 3 μm and having a dielectric constant of not less than 100, the weight average particle size of the dielectric particles being not more than 30% of that of the semiconducting particles, the amount of the dielectric particles being 5 to 40 vol % based on the total particles, and the amount of the particles in the whole fluid being 10 to 60 vol %.

2. An electroviscous fluid according to claim 1, wherein said electrical insulating liquid has a resistivity of not less than $10^9$ Ωcm.

3. An electroviscous fluid according to claim 1, wherein said electrical insulating liquid is one selected from the group consisting of dimethyl polysiloxane, dioctyl phthalate, dibutyl phthalate, diisononyl phthalate, trioctyl trimellitate, triisodecyl trimellitate, dibutyl adipate, butyl stearate, paraffin-based mineral oil and naphthene-based mineral oil.

4. An electroviscous fluid according to claim 1, wherein said semiconducting particles are the particles of one selected from the group consisting of a carbonaceous material obtained by heating a hydrocarbon at a temperature of not higher than 1000° C. and polyacene quinone.

5. An electroviscous fluid according to claim 1, wherein said semiconducting particles have a weight average particle size of 5 to 50 μm.

6. An electroviscous fluid according to claim 1, wherein said semiconducting particles have a specific gravity of not more than 3.

7. An electroviscous fluid according to claim 1, wherein said dielectric particles are particles of one selected from the group consisting of $BaTiO_3$, (Ba, Sr, Ca)$TiO_3$, (Ba, Ca)(Zr, Ti)$O_3$, Pb(Zn, Nb)$O_3$, Pb(Fe, Nb)$O_3$, Pb(Mg, Nb)$O_3$ and Pb(Fe, W)$O_3$.

8. An electroviscous fluid according to claim 1, wherein said dielectric particles have a weight average particle size of 0.3 to 2 μm.

9. An electrovicous fluid comprising an electrical insulating liquid and partcles dispersed therein, said particles being composed of (i) semiconducting particles having a weight average particle size of 1 to 100 μm, the semiconducting particles being particles of at least one member selected from the group consisting of a carbonaceous material obtained by heating a hydrocarbon at a temperature of not higher than 1000° C. and polyacene quinone, and (ii) dielectric particles having a weight average particle size of 0.1 to 3 μm, the dielectric particles being particles of at least one member selected from the group consisting of $BaTiO_3$, (Ba, Sr, Ca) $TiO_3$, (Ba, Ca)(Zr, Ti)$O_3$, Pb(Zn, Nb)$O_3$, Pb(Fe, Nb)$O_3$, Pb(Mg, Nb)$O_3$ and Pb(Fe, W)$O_3$, the weight average particle size of the dielectric particles being not more than 30% of that of the semiconducting partcles, the amount of the dielectric particles being 5 to 40 vol % based on the total particles, and the amount of the partcles in the whole fluid being 10 to 60 vol %.

* * * * *